US007465225B2

(12) United States Patent
Ohmura et al.

(10) Patent No.: US 7,465,225 B2
(45) Date of Patent: Dec. 16, 2008

(54) CLEAN ROOM UNIT

(75) Inventors: Shiro Ohmura, Tokyo (JP); Yoshihito Ohmura, Tokyo (JP); Hideaki Hirobe, Tokyo (JP); Takehiko Imura, Tokyo (JP)

(73) Assignee: Tosho, Inc., Tokyo (JP)

( * ) Notice: Subject to any disclaimer, the term of this patent is extended or adjusted under 35 U.S.C. 154(b) by 516 days.

(21) Appl. No.: 10/546,584

(22) PCT Filed: Jun. 3, 2004

(86) PCT No.: PCT/JP2004/007707

§ 371 (c)(1),
(2), (4) Date: Sep. 26, 2005

(87) PCT Pub. No.: WO2005/119131

PCT Pub. Date: Dec. 15, 2005

(65) Prior Publication Data

US 2007/0066205 A1 Mar. 22, 2007

(51) Int. Cl.
*F24F 7/06* (2006.01)
*B01L 1/04* (2006.01)
*B08B 15/02* (2006.01)

(52) U.S. Cl. ..... 454/187; 454/56; 454/229; 55/385.2

(58) Field of Classification Search ..... 454/187, 454/229, 56; 55/385.2
See application file for complete search history.

(56) References Cited

U.S. PATENT DOCUMENTS 4,267,769 A * 5/1981 Davis et al. ..... 454/187
4,497,242 A * 2/1985 Moyer ..... 454/61
4,667,580 A * 5/1987 Wetzel ..... 454/187
5,074,894 A * 12/1991 Nelson ..... 96/224
5,086,692 A * 2/1992 Welch et al. ..... 454/187
5,205,783 A * 4/1993 Dieckert et al. ..... 454/238
5,533,606 A * 7/1996 Yuyama ..... 198/349
5,913,773 A * 6/1999 Cox ..... 5/600
6,491,735 B2 * 12/2002 Najm ..... 55/492

FOREIGN PATENT DOCUMENTS

DE 3540263 A1 * 5/1987
JP 54098039 A * 8/1979
JP 61-92370 6/1986
JP 63-188433 12/1988
JP 1-118046 5/1989

(Continued)

*Primary Examiner*—Steven B McAllister
*Assistant Examiner*—Patrick F. O'Reilly, III
(74) *Attorney, Agent, or Firm*—Jordan and Hamburg LLP

(57) ABSTRACT

A clean room unit which is equipped with a work room and a clean bench unit can be independently installed inside a building, can generate an air shower in the work room, and can realize miniaturization and cost reduction. The clean room has a work room, a clean bench unit which has a work opening and has the work opening installed to look onto the work room, an air conditioning system which can perform purification and pressure control of air inside the work room and the clean bench unit and can generate an air shower in the work room, and a control unit. The air conditioning system is controlled by the control unit to switch exclusively between the air shower mode, the ventilation mode, the positively-pressurized work mode, and the negatively-pressurized work mode.

13 Claims, 7 Drawing Sheets

FOREIGN PATENT DOCUMENTS

| | | | |
|---|---|---|---|
| JP | 03263534 A | * | 11/1991 |
| JP | 6-249482 | | 9/1994 |
| JP | 09225008 A | * | 9/1997 |
| JP | 2000-320872 | | 11/2000 |
| JP | 2003-83578 | | 3/2003 |
| JP | 2004-183951 | | 7/2004 |

* cited by examiner

| operation mode | air shower | ventilation | positively-pressurized work | negatively-pressurized work |
|---|---|---|---|---|
| air intake/circulation fan | operating ($9m^3$/min) | operating ($5m^3$/min) | operating ($5m^3$/min) | operating ($5m^3$/min) |
| exhaust fan | stopped | operating | stop | operating |
| CB circulation fan | stopped | operating | operating ($10m^3$/min) | operating ($15m^3$/min) |
| air intake switching damper (MD1) | closed | open | open | open |
| jet switching damper (MD2) | closed | open | open | open |
| circulation switching damper (MD3) | open | closed | closed | closed |
| CB exhaust switching damper (MD4) | closed | open | closed | open |

Fig. 8

CLEAN ROOM UNIT

TECHNICAL FIELD

The present invention relates to a clean room unit equipped with a work room and a clean bench isolated from the exterior, installed independently inside a building.

BACKGROUND OF THE RELATED ART

Ordinarily, a clean room is installed in medical facilities such as hospitals, in which medicines are prepared. In medical facilities, a room in the building is set aside as a clean room, the air is cleaned by an air conditioner and the pressure adjusted to make it a clean room. When ordinary medicines are prepared in the clean room, the clean room is positively pressurized so that outside air containing bacteria and dust does not enter.

On the other hand, when preparing an anti-cancer drug (a powerful medicine), the clean room is negatively pressurized. Namely, the air inside the clean room where preparation of the anti-cancer drug is performed becomes air containing ingredients of the anti-cancer drug, and the air is prevented from leaking out to outside of the room. However, this increases the possibility of workers inside the clean room coming into contact with air containing the anti-cancer drug ingredient and inhaling the air.

This increases the need to install a separate clean bench within which anti-cancer drugs are prepared.

A common clean bench is equipped with a work table within which is installed a work space, a work opening formed on the front side of the work space, an open/close shutter which opens/closes the work opening, and an air conditioner which purifies and adjusts the pressure of the air of the work space. When medicine is prepared using this clean bench, the worker opens the open/close shutter appropriately, inserts his hands through the work opening into the work space, and prepares the medicine on the work table.

In preparing an anti-cancer drug using the clean bench, if the interior of the work space is negatively pressurized, it becomes difficult for the air containing ingredients of the anti-cancer drug inside the work space to leak outside. However, because the outside air comes into the work space, in order to decontaminate the air from bacteria, dust, etc., a clean bench still needs to be installed in the clean room.

A pre-room is installed adjacent to the clean room, in which an air shower and an aseptic hand washer are installed. Each worker enters the clean room after dust removal and sterilization in the pre-room.

However, the prior art technology has the following problems.

(A) Because a room in the building is itself set aside as a clean room, the clean room becomes unnecessarily large, and in order to maintain the air inside the clean room at a high level of purity, the air purification apparatus is necessarily large. Also, it takes time to exhaust the air from within the clean room, increasing operating costs.

(B) Furthermore, if a clean bench is separately installed in a clean room, a pre-room for preparing to enter the clean room is separately installed, in which an air shower is installed, making the installation cost to be very high.

(C) In general hospitals, in order to efficiently perform a series of medical functions, including the preparation of medicine, a request is made to install a clean room where medicine preparation can be performed for each clinical section and further for each hospital ward or each floor of each ward if there is an inpatient facility. However, this is often impossible to realize in consideration of space and cost.

On the other hand, JP 2000-320872 discloses a clean room equipped with a pre-room, a positively-pressurized room, a negatively-pressurized room, a safe cabinet (clean bench), and an air circulation system.

The air shower device and a aseptic hand washer are installed in the pre-room, the positively-pressurized room adjoins the pre-room, the negatively-pressurized room adjoins the positively-pressurized room, and the safe cabinet is installed in the negatively-pressurized room. Air inside the positively-pressurized room, the negatively-pressurized room, and the safe cabinet is pressure controlled by the air circulation system. The air shower installed in the pre-room is separate from the air circulation system.

It is presumed that a room in the building itself is set aside as the clean room, in which case the same problems as those cited in (A)~(C) will occur. If the clean room is installed independently within a building, although the problems may improve somewhat, the following problems exist.

(a) Because the negatively-pressurized room is installed separate from the positively-pressurized room and the pre-room for performing an air shower is installed separate from the positively-pressurized room and negatively-pressurized room, miniaturization of the clean room has a limit, and the air circulation system may become large.

(b) Furthermore, because the air shower device becomes necessary in the pre-room separate from the air circulation system, the manufacturing cost of the clean room becomes very high.

(c) Because the worker needs to move among rooms of the pre-room, the positively-pressurized room, and the negatively-pressurized room, the workload increases.

The objective of the present invention is to install a clean room equipped with a work room and an independent clean bench inside a building, to have its air shower generated by an air conditioning system, to make the work room positively pressurized or negatively pressurized to enable the worker inside the work room to perform medicine preparation using the clean bench, and to realize miniaturization and cost reduction, etc.

SUMMARY OF THE INVENTION

The clean room unit according to the present invention is provided with a work room isolated from the exterior and a clean bench unit which has a work opening facing the work room, and is installed independently inside a building; this clean room unit is characterized by comprising: an air conditioning system which can perform purification and pressure control of the air inside the work room and a clean bench unit and can generate an air shower in the work room, and an air conditioning control means which controls the air conditioning system so as to switch the air conditioning system between the air shower mode to generate an air shower in the work room and the work mode to enable specific work by making the work room to be positively pressurized or negatively pressurized.

Switching the function (the air shower mode, the work mode) of the clean room unit may be performed by a worker by means of operating the controls, or various kinds of sensors may be provided to automatically perform this by detecting the worker's actions.

When the air conditioning system is controlled by the air conditioning control means and, when the air conditioning system is switched to the air shower mode, an air shower is generated in the work room. A worker who has entered the work room can remove dust by taking the air shower. The worker will commence preparation of medicines after the dust removal.

Next, when the air conditioning system is controlled by the air conditioning control means and the air conditioning system is switched to the work mode, the work room becomes positively or negatively pressurized, enabling the worker inside the work room to insert his hands to the clean bench unit through the work opening to prepare medicines.

If the work room is positively pressurized in the work mode, outside air stops entering the work room. Also, if the work room is negatively pressurized in the work mode, because air inside the work room stops leaking to the outside, it becomes fit for preparing anti-cancer drugs (powerful medicines).

The clean room unit achieves the following significant advantages.

By installing the work room, clean room, air conditioning system, and air conditioning control means, the worker can take an air shower in the work room after entering the work room, and can then prepare medicines using the clean bench unit in the work room, creating an appropriate environment for preparing medicines. Because there is no need to separately install a pre-room having an air shower device as has been done conventionally, and an air shower can be generated by the air conditioning system, with no need to install a separate air shower. Furthermore, the air conditioning system can be miniaturized, reducing the cost of the clean room.

Because the clean room unit can be miniaturized and independently installed inside a building, in medical facilities a place of installation for this clean room unit can be easily secured, and a useful clean room unit can be provided which can replace a conventional clean room, pre-room (air shower device), and clean bench unit.

Because the room in which the clean room unit is installed does not need to be made as a clean room, the cost of the facility can be greatly reduced. If the clean room unit is installed in a clean room, a more desirable environment can be created for preparing medicines.

Preferred constitutions of the present invention will be described next.

The clean bench unit has an open/close shutter which opens/closes the work opening and a shutter open/close detection means which detects whether the open/close shutter is open or closed, and the air conditioning control means prohibits switching to the shower mode when it is detected by the shutter open/close detection means that the open/close shutter is open.

If an air shower is generated in the work room with the open/close shutter open, air containing dust etc. which are removed by an air shower enters the clean bench unit through the work opening, which is not desirable. The occurrence of such a situation can be securely prevented.

The clean bench unit has an automatic mat replacement device which automatically replaces a mat placed on a work table by sliding it.

The mat placed on the work table makes the work table hygienic, so that medicine etc. dropped during preparing medicines can be caught by the mat. Although the mat placed on the work table becomes dirty once medicine is prepared, the mat is automatically replaced by the automatic mat replacement device. Because the mat replacing work which used to be performed by the worker can be automated, the workload can be significantly reduced.

The automatic mat replacement device has a mat supply unit in which a rolled mat is detachably mounted and a mat winding means which successively feeds the mat mounted in the mat supply unit onto the work table and winds up the used mat.

A rolled mat can be mounted in the mat supply unit and the mat placed on the work table can be securely replaced by the mat winding means. Also, because the used mat is also rolled, disposal of the used mat can be also easily performed.

A mat remaining amount detection means which detects the remaining amount of the mat mounted in the mat supply unit and a mat remaining amount reporting means which reports the remaining amount of the mat detected by this mat remaining amount detection means are installed.

A worker can securely know the remaining amount of the mat mounted in the mat supply unit, and when the mat mounted in the mat supply unit runs out, a new mat can be readily mounted in the mat supply unit.

A display, visible to the worker, is provided, along with an information processing computer on which at least medicine information is displayed.

The display is installed inside the work room or the clean bench unit. The worker can see and check the information on the display relating to preparing medicines. Also, the information processing computer can show patient information, medicine history information, prescription information, protocol information in the case of preparing anti-cancer drugs, preparation procedure information, inspection information, etc., supporting the preparation of medicines by the worker.

A medicine port is installed for passing medicines into or out of the work room, along with an IC chip reader for reading medicine information from an IC chip attached to the medicine or medicine tray taken into the work room through the medicine port.

Medicines can be transferred through the medicine port to the work room without opening the entrance/exit of the work room for workers while maintaining the purity of the work room air as much as possible. Medicine information can be read by the IC chip reader from the IC chip attached to the medicine or medicine tray taken into the work room through the medicine port, and shown securely on the display.

The IC chip is attached to the medicine tray, and the IC chip reader is installed in the medicine port on which the medicine tray can be placed.

When the medicine tray to be sent into the work room is placed on the medicine port, medicine information is automatically read from the IC chip attached to the medicine tray by the IC chip reader installed in the medicine port, reducing the workload.

The work mode includes the negatively-pressurized work mode in which the work room and the clean bench unit interior are negatively pressurized.

Once switched to the negatively-pressurized work mode, the work room and the clean bench unit interior become negatively pressurized, and air inside the work room stops leaking to the outside. Hence, it becomes fit for preparing anti-cancer drugs, securely preventing the air containing ingredients of the anti-cancer drug from leaking to the outside. It is desired that the pressure inside the clean bench unit be made lower than that inside the work room, in which case, because air inside the clean bench unit stops leaking to the work room, an environment is created which is also fit for workers.

The work mode includes the positively-pressurized work mode where the work room is made to be positively pressurized and the clean bench unit interior is given the room pressure.

Once switched to the positively-pressurized work mode, the work room becomes positively pressurized, the clean bench interior is established at room pressure, and air outside the room stops entering the work room. Also, air inside the clean bench stops leaking into the work room. Hence, the purity of air inside the clean bench is maintained, along with the purity of air inside the work room, becoming a state fit for normal preparation of medicine.

The air conditioning control means can switch the air conditioning system exclusively to one of the air shower mode, the work mode, or the ventilation mode in which the work room and the clean bench interior are forcibly ventilated while performing air intake and exhaust.

Before a worker enters the work room or after the preparation of anti-cancer drugs, it can be switched to the ventilation mode to ventilate the work room and the clean bench unit interior.

The air conditioning system has an air intake path through which air is taken into the work room, a work room circulation path which includes a part of the air intake path, a clean bench unit circulation path, a common exhaust path which exhausts from the work room and the clean bench unit, an air intake/circulation fan and an air intake switching damper installed in the air intake path, a circulation switching damper installed in the work room circulation path, a clean bench unit circulation fan installed in the clean bench unit circulation path, an exhaust damper installed in a path connecting the clean bench unit circulation path and the exhaust path, and an exhaust fan installed in the exhaust path.

By installing multiple paths, multiple fans, and multiple dampers in an air conditioning system, the air conditioning system can be switched to the air shower mode, the work mode (positively-pressurized mode and negatively-pressurized mode), and the ventilation mode.

The air conditioning system has multiple silencers installed in each of the air intake path and clean bench unit circulation path.

The operating noise of the multiple fans and the noise of air flowing in the paths can be silenced to increase the quietude.

Construction is such that multiple air nozzles are installed on the ceiling of the work room, the air nozzles being used both as air jets in the air shower mode and air jets in the work mode.

Because multiple air nozzles can be shared as the air jet in the air shower mode and the air jet in the work mode, the structure can be simplified.

BRIEF DESCRIPTION OF THE DRAWINGS

FIG. 8 is a chart showing the actions of the fans and dampers for each of the clean room operating modes.

DETAILED DESCRIPTION OF THE PREFERRED EMBODIMENTS

Figure 1:
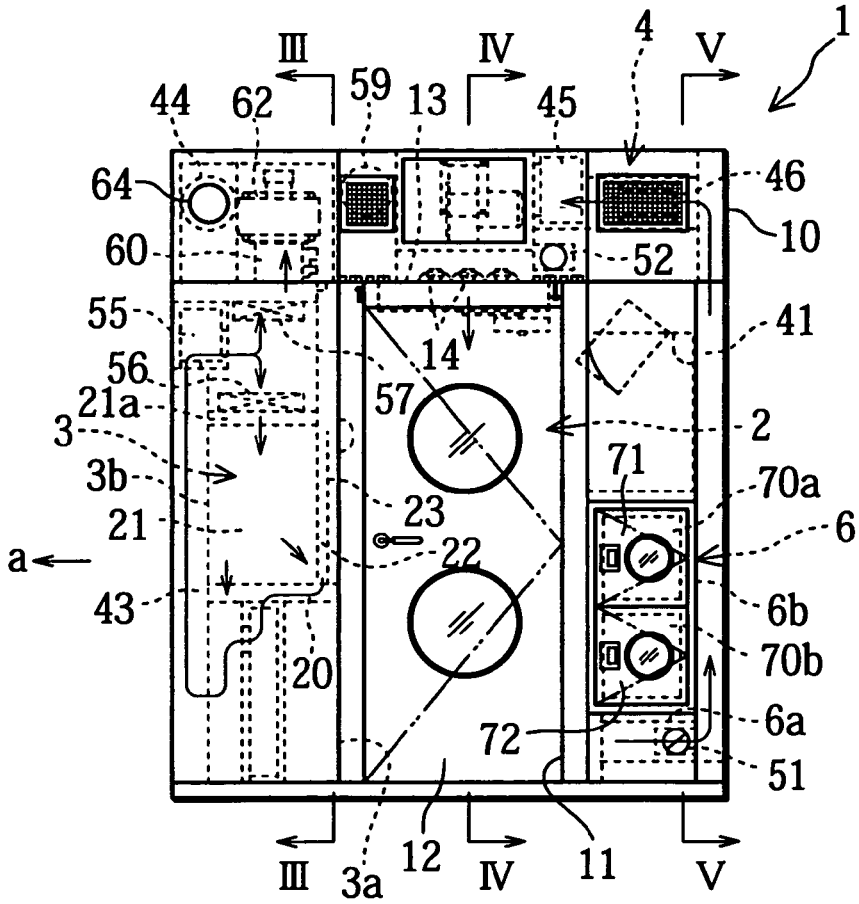
FIG. 1 is a front view of the clean room unit.
Figure 2:
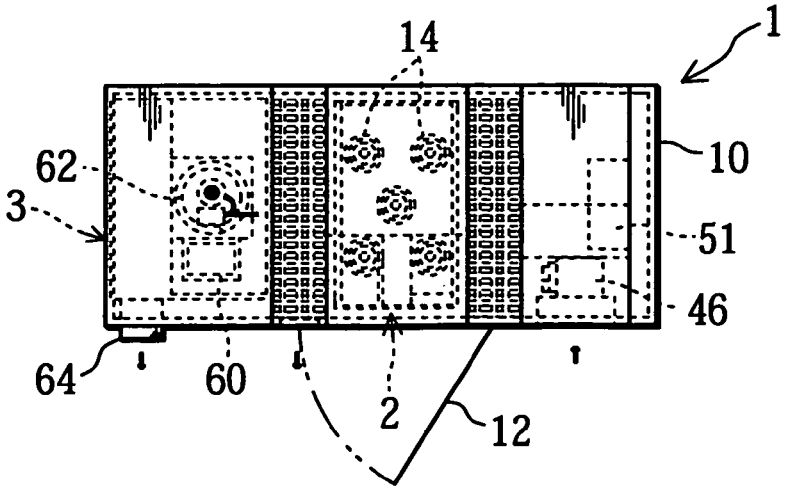
FIG. 2 is a plane view of the clean room unit.
Figure 3:
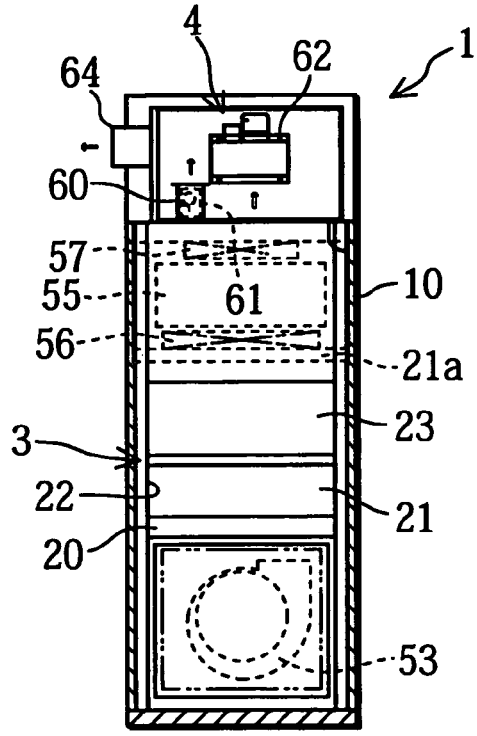
FIG. 3 is a cross-sectional view of the III-III line in FIG. 1.

Embodiments of the present invention will be described hereafter, based on the drawings. Explanations are given regarding an arrow a in FIG. 1 as being the left direction.

A clean room unit 1 is installed independently inside a building. As shown in FIG. 1~FIG. 5, the clean room unit 1 is equipped with a work room 2 isolated from the exterior, a clean bench unit 3 installed so that it has a work opening 22 and the work opening 22 faces to the work room 2, an air conditioning system 4 which can purify and control the air pressure inside the work room 2 and the clean bench unit 3 and generate an air shower inside the work room 2, a control unit 5 (corresponding to an air conditioning control means, see FIG. 7) which controls the air conditioning system 4 and switches the air conditioning system 4 exclusively among the air shower mode which generates an air shower in the work room 2 (see FIG. 9), the ventilation mode which forcibly ventilates the inside of the work room 2 and the inside of clean bench unit 3 (see FIG. 10), the positively-pressurized mode which enables preparation of medicines with the work room 2 positively pressurized (see FIG. 11), and the negatively-pressurized mode which enables preparation of medicines with the work room 2 being negatively pressurized (see FIG. 12).

As shown in FIG. 1~FIG. 5, the clean room unit 1 has a housing 10 in a rectangular parallelepiped shape, in which are installed the work room 2, the clean bench unit 3, the air conditioning system 4, and the control unit 5. The dimensions of the housing 10 are, for example, width 2000 mm, depth 900 mm, and height 2500 mm. The clean bench unit 3 is installed on the left part of the housing 10, the work room 2 is installed on the right side, and a pass box 6 is installed in the part which is on the front side and the right side of the work room 2. The upper side of the pass box 6 is a space which connects to the work room 2. The widths of the clean bench unit 3, work room 2, and pass box 6 are, for example, 600 mm, 900 mm, and 500 mm, respectively.

Installed in the front side of the work room 2 are a worker entrance 11 formed on the housing 10 and a door 12 which opens/closes this entrance 11. Inside the housing 10, a ceiling 13 above the clean bench unit 3 and the work room 2 is installed at height 1900 mm for example.

As shown in FIG. 1~FIG. 5 and FIG. 9~FIG. 12, multiple (five for example) air nozzles 14 are installed on a part of the ceiling 13 which is above the work room 2, and a punching face type jet 15 is installed on the ceiling part above the pass box 6. Installed on the upper side of the ceiling 13 are an air intake/circulation fan 45, an exhaust fan 62, an air intake switching damper 46, a jet switching damper 52, a positive pressure switching damper 59, a clean bench unit exhaust damper 61 (called as a CB exhaust switching damper, hereinafter), silencers 47 and 48, a filter 49, and a HEPA filter 50.

A bottom plate 6*a* of the pass box 6 is installed at a height of 260 mm for example, and a right-side plate 6*b* of the pass box 6 is installed, for example, at a distance of 100 mm toward the left from the right-side plate of the housing 10. A circulation switching damper 51 is installed below the bottom plate 6*a* of the pass box 6, and a part of the work room circulation path 41 is formed below the bottom plate 6*a* and to the right of the right-side plate 6*b* connected to it.

The clean bench unit 3 has a work table 20 installed inside it and a work space 21 on its top, a work opening 22 formed in the right side of the work space 21, an open/close shutter 23 which opens/closes the work opening 22, a shutter open/close detection sensor 24 which detects open/close of the open/ close shutter 23 (see FIG. 7), an automatic mat replacement device 30 which automatically replaces a mat M placed on the work table 20 by sliding it (see FIG. 6), a clean bench circulation path 43 (called as a CB circulation path 43, hereinafter), a clean bench unit circulation fan 53 (called as a CB circulation fan 53, hereinafter), silencers 54 and 55, and filters 56 and 57. The CB circulation path 43, the CB circulation fan 53, the silencers 54 and 55, and the filters 56 and 57 are included in the air conditioning system 4.

The clean bench unit 3 is separated from the interior of the work room 2 with the right-side plate 3*a* at other than the work opening 22. The major part of the open/close shutter 23 comprises a transparent plate, and the open/close shutter 23 is supported to the frame of the clean bench unit 3 so that it can slide up/down and stop in the middle of the sliding range. For example, the height of the work table 20 is 750 mm, the depth of the work table 20 and the work space 21 is 800 mm, and height of the upper wall 21*a* of the work space 21 is 1350 mm.

Figure 6:
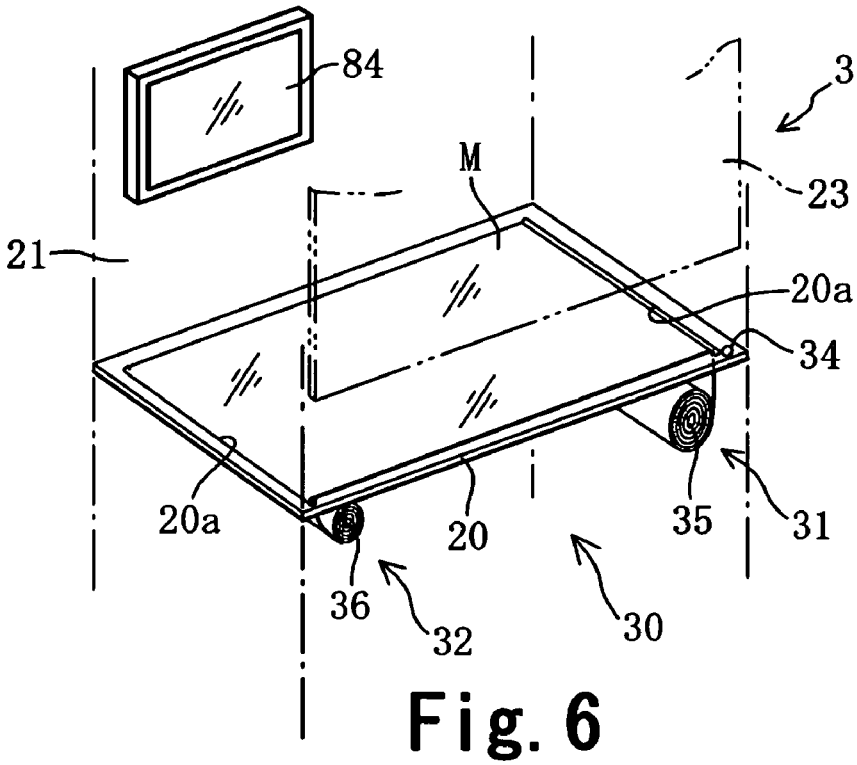
FIG. 6 is an oblique view of the essential part of the clean bench unit including the automatic mat replacement device.

As shown in FIG. 6, the automatic mat replacement device 30 has a mat supply unit 31 wherein a rolled mat M is detachably mounted, a mat winding mechanism 32 which successively feeds the mat M mounted in the mat supply unit 31 onto the work table 20 and successively winds up the used mat M, a mat remaining amount detection sensor 33 (see FIG. 7) which detects the remaining amount of the mat M mounted in the mat supply unit 31, and a mat remaining amount reporting lamp 34 which reports the remaining amount of the mat detected by the mat remaining amount detection sensor.

For example, the mat supply unit 31 is installed below the rear section of the work table 20, and the mat winding mechanism 32 is installed below the front section of the work table 20. Formed on the work table 20 are a pair of front/rear horizontally-long slits 20*a*, the mat M extending from the mat supply unit 31 is introduced onto the work table 20 through the rear slit 20*a*, and the mat M on the work table is introduced toward the mat winding mechanism 32 through the front slit 20*a*.

The mat supply unit 31 has a rotation axis 35 supported by the work table 20 and oriented in the right-left direction, and a core tube around which the mat M is rolled is attached to the rotation axis 35.

The mat winding mechanism 32 has a winding shaft 36 in the right-left direction supported by the work table 20 and a mat winding motor 37 (see FIG. 7) which rotates the winding shaft 36, and the used mat M is rolled up to the winding shaft 36 or the winding core tube attached to the winding shaft 36.

By installing such an automatic mat replacement device 30, a rolled mat M can be attached to the mat supply unit 31, and the mat M placed on the work table 20 can be securely replaced by the mat winding mechanism 32. Because the used mat M also becomes rolled up, disposal of the used mat M can be performed easily.

Also, because the mat remaining amount detection sensor 33 and the mat remaining amount reporting lamp 34 are installed, the worker can know for sure the remaining amount of the mat M mounted to the mat supply unit 31. Hence, when the mat M mounted to the mat supply unit 31 has run out, a new mat M can be readily mounted to the mat supply unit 31.

Figure 7:
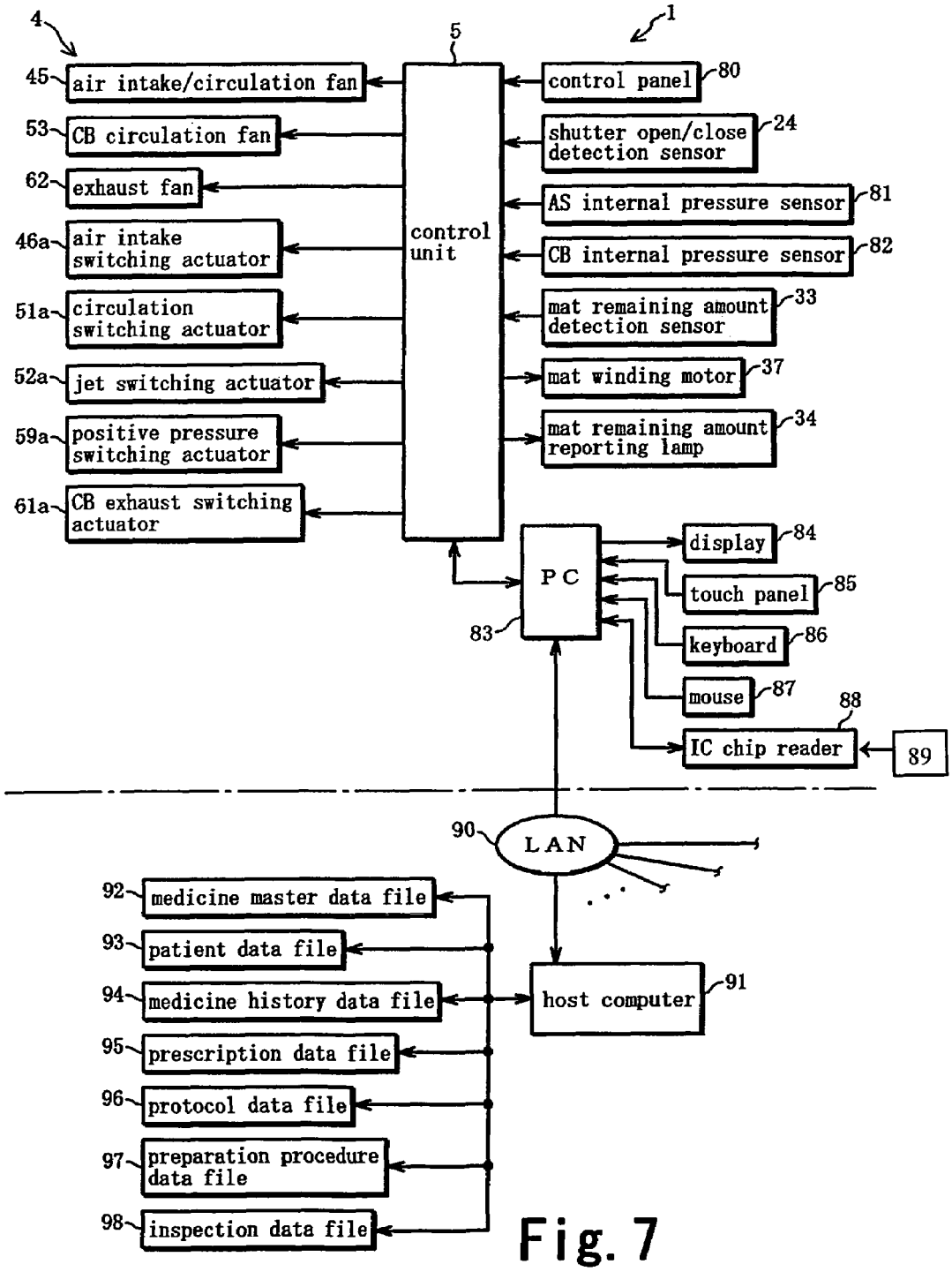
FIG. 7 is a block diagram of the control system of the clean room unit.

Installed in this clean room unit 1 are, as shown in FIG. 6 and FIG. 7, a display 84 which can be viewed by a worker in the work room 2 and an information processing computer 83 (which is a personal computer, hereafter referred to as PC 83) which has the display 84 show at least the medicine information.

The display 84 comprises a thin-type liquid crystal or plasma display and is placed at an easy-to-see position in the work space 21 of the clean bench unit 3. The display 84 may also be placed at an easy-to-see position in the work room 2.

As shown in FIG. 1~FIG. 5, FIG. 6, and FIG. 9~FIG. 12, the air conditioning system 4 has an air intake path 40 through which air is taken into the work room 2, a work room circulation path 41 which includes a part of the air intake path 40, a jet switching path 42 which is a branch path of the work room circulation path 41, a CB circulation path 43, a common exhaust path 44 which exhausts from the work room 2 and the clean bench unit 3, an air intake/circulation fan 45, an air intake switching damper 46, silencers 47 and 48, a filter 49, and a HEPA filter 50 (these elements 45~50 are installed in the air intake path 40), a circulation switching damper 51 installed in the work room circulation path 41, a jet switching damper 52 installed in the jet switching path 42, a CB circulation fan 53, silencers 54 and 55, and a filter 56 (these elements 53~56 are installed in the CB circulation path 43), a positive pressure switching damper 59 installed in a path which branches from a path 58 connecting the work room circulation path 41 and the exhaust path 44 and reaches the outside, an exhaust damper 61 and a filter 57 installed in a path 60 which connects the CB circulation path 43 and the exhaust path 44, an exhaust fan 62 installed in the exhaust path 44, and five actuators 46*a*, 51*a*, 52*a*, 59*a*, and 61*a* which open/close the five dampers 46, 51, 52, 59, and 61, respectively.

The work room circulation path 41 is a path for circulating air as the work room 2→below the bottom plate 6*a* of the pass box 6→right side of the right-side wall 6*b*→above the ceiling 13→the work room 2→ . . . , where air above the ceiling 13 is jetted through multiple air nozzles 14 and a jet 15 to the work room 2.

Installed in this work room circulation path 41 above the ceiling 13 are the silencer 47, the air intake/circulation fan 45, the silencer 48, and the HEPA filter 50 sequentially from the upper stream side. This part of the path where the silencer 47, the air intake/circulation fan 45, the silencer 48, and the HEPA filter 50 are installed is shared with the air intake path 40. Also, in the work room circulation path 41, the part of the path between the HEPA filter 50 and multiple air nozzles 14 is connected to the exhaust path 44 via the path 58.

In the air intake path 40, the filter 49 and the air intake damper 46 are installed in the part of the path in the upper stream which is not shared with the work room circulation path 41.

The jet switching path 42 is a part of the work room circulation path 41 which branches from the lower stream side of the HEPA filter 50 and reaches the jet 15.

The CB circulation path 43 is a path for circulating air inside the clean bench unit 3 as the work space 21→below the work table 20→left side of separation plate 3*b* located in the left side of the work space 21→above the top plate 21*a* of the work space 21→the work space 21.

The CB circulation fan 53 and the silencer 54 are installed below the work table 20, the silencer 55 and the filters 56 and 57 are installed above the top plate 24. In the CB circulation path 43, the part of the path between the silencer 55 and the filter 56 is connected to the exhaust path 44 via the path 60.

Because multiple silencers 47, 48, 54, and 55 are installed in the air conditioning system 4, operating noise of the fans 45, 53, and 62, and sound of air flowing through the path can be silenced, increasing the quietude.

Note that an exhaust duct 64 is connected to the exhaust path 44, and air in the exhaust path 44 is exhausted to the outside through this exhaust duct 64. In this case, it is preferably constructed so that exhaust is performed by the exhaust duct 64 to the outside of the room wherein the clean room unit 1 is installed. However, because the exhausted air is the air purified by the HEPA filter 50 and the filter 57, it may be exhausted into the room where the clean room unit 1 is installed.

Figure 4:
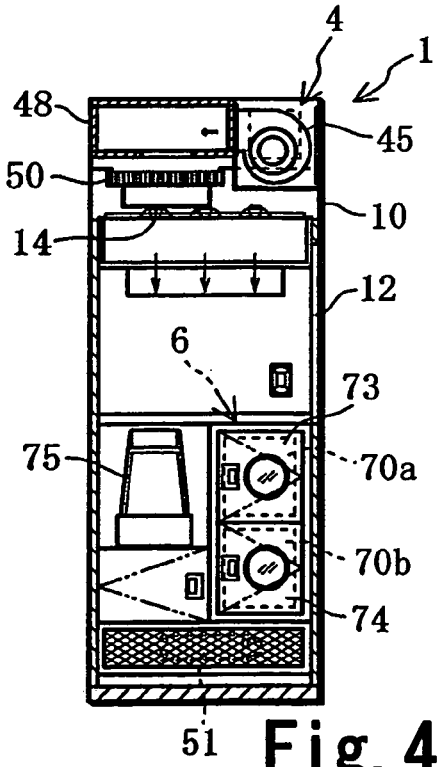
FIG. 4 is a cross-sectional view of the IV-IV line in FIG. 1.
Figure 5:
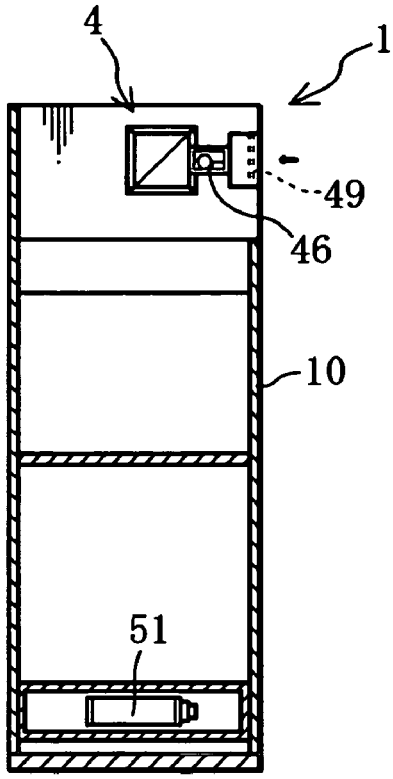
FIG. 5 is a cross-sectional view of the V-V line in FIG. 1.

As shown in FIG. 1 and FIG. 4, the pass box 6 corresponds to the medicine port for passing medicines into or out of the work room 2 and comprises a first pass box 70*a* for taking medicines, medicine preparation equipment, etc. from outside into the work room 2, and a second pass box 70*b* for putting used medicine containers, medicine preparation equipment, etc. out of the work room 2.

Outer doors 71 and 72 which can be operated open/close from outside and inner doors 73 and 74 which can be operated open/close from the work room 2 are installed in the first and second pass boxes 70*a* and 70*b*, respectively.

If an IC chip 89 is attached to the medicine or medicine tray put into the work room 2 from through first pass box 70*a*, an IC chip reader 88 (see FIG. 7) for reading information from that IC chip 89 is installed.

In this IC chip 89, at least the medicine information of the medicine contained on the medicine tray is recorded, and the information is written into the IC chip 89 with an IC chip writer (not shown) when the medicine contained on the medicine tray is prepared for example.

The IC chip reader 88 may be constructed so that it can be held by the worker by hand to operate, and it is assumed in this embodiment that the IC chip 89 is attached to the medicine tray, and the IC chip reader 88 is mounted on the bottom plate of the first pass box 70*a* where the medicine tray can be placed.

In each of the pass boxes 70*a* and 70*b*, both the outer door 71, 72 and the inner door 73, 74 become open, and an interlock mechanism which locks one of the outer door 71, 72 and the inner door 73, 74 does not open when the other is open may be installed so that the outside air will not directly enter the work room 2 through the pass box 70*a* or 70*b*. Also, in the first pass box 70*a* for taking medicines and medicine preparation equipment from the outside into the work room 2, a cleaning apparatus for cleaning the medicines and medicine preparation equipment may be installed. Note that in the rear of the pass box 6 an aseptic hand washer 75 is installed to sterilize the worker's hands.

The control system of the clean room 1 will be described.

As shown in FIG. 7, the control unit 5 is installed, and signals are supplied to the control unit 5 from a control panel 80, the shutter open/close detection sensor 24, an AS internal pressure sensor 81, a CB internal pressure sensor 82, and the mat remaining amount detection sensor 33.

The control panel 80 is installed inside and/or outside the work room 2, and installed on this control panel 80 are a power supply SW, an air shower SW, a ventilation SW, a positively-pressurized work SW, and a negatively-pressurized work SW. The internal pressure sensor 81 is a sensor which detects the air pressure inside the work room 2, and the CB internal pressure sensor 82 is a sensor which detects the air pressure inside the clean bench unit 3.

The control unit 5 controls the fans 45, 53, and 62, and the switching actuators 46*a*, 51*a*, 52*a*, 59*a*, and 61*a* based on the signals supplied from the control panel 80 and the sensors 81, 82, and control programs stored in a ROM, etc. In this case, if one of the air shower SW, the ventilation SW, the positively-pressurized work SW, and the negatively-pressurized work SW is turned on while the power supply SW is on, according to the SW which is turned on, the fans 45, 53, and 62, and the switching actuators 46*a*, 51*a*, 52*a*, 59*a* , and 61*a* are controlled by the control unit 5 so that they become operational state as shown in FIG. 8 to switch the air conditioning system 4 to one of the air shower mode, the ventilation mode, the positively-pressurized work mode, and negatively-pressurized work mode.

Figure 9:
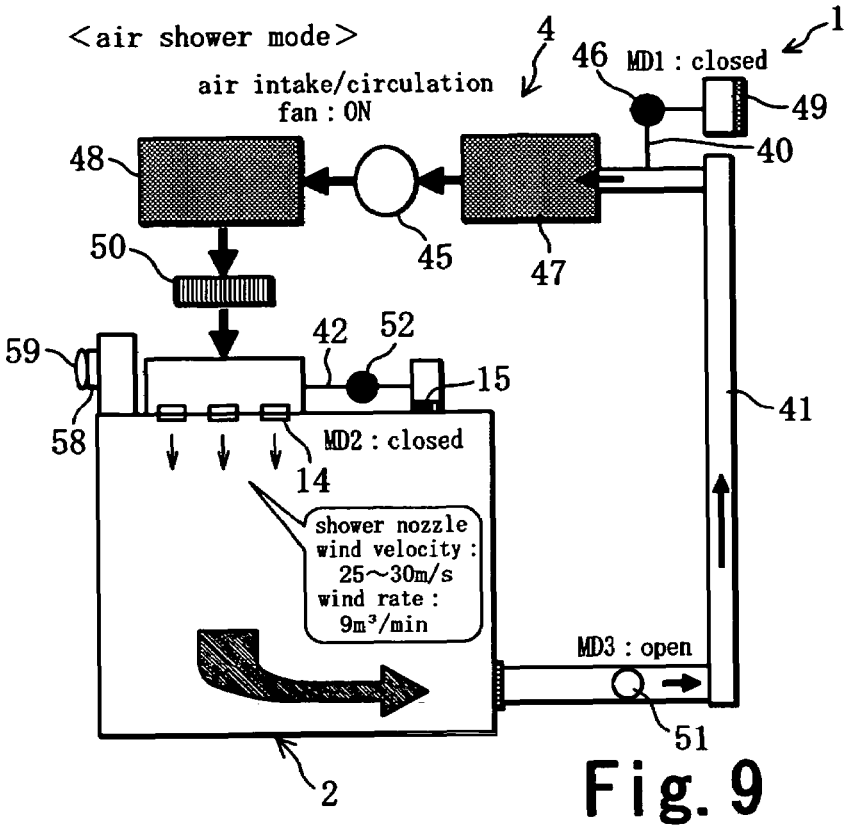
FIG. 9 is an explanatory diagram of the clean room unit in the air shower mode.

As shown in FIG. 9, once the air conditioning system 4 enters the air shower mode, air circulates in the circulation path 41, and air purified by the HEPA filter 50 is jetted to the work room 2 at a wind velocity of 25~30 m/s and a wind rate of 9 $m^3$/min, generating an air shower. Note that the control unit 5 prohibits switching to the shower mode if it is detected by the shutter open/close detection sensor 24 that the open/close shutter 23 is open. In this case, a reporting lamp may be installed and the reporting lamp may be lit to so notify a worker, for example.

Figure 10:
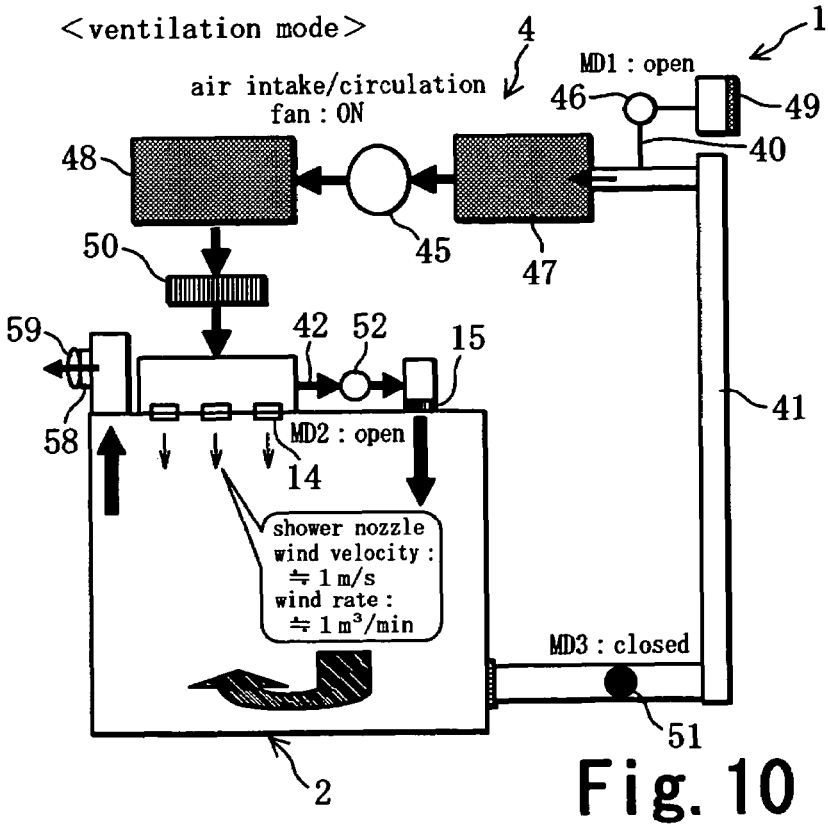
FIG. 10 is an explanatory diagram of the clean room unit in the ventilation mode.

As shown in FIG. 10, once the air conditioning system 4 enters the ventilation mode, the circulation path 41 is shut off, air is taken in through the air intake path 40, purified by the HEPA filter 50, jetted to the work room 2 through the air nozzles 14 at wind velocity of about 1 m/s and a wind rate of about 1 $m^3$/min, and jetted through the jet 15, as well. Air inside the work room 2 is exhausted directly through the exhaust path 44. Also, the clean bench unit 3 is also operated for ventilation, performing intake and ventilation in this way, and the work room 2 and the interior of the clean bench unit 3 are forcibly ventilated.

Figure 11:
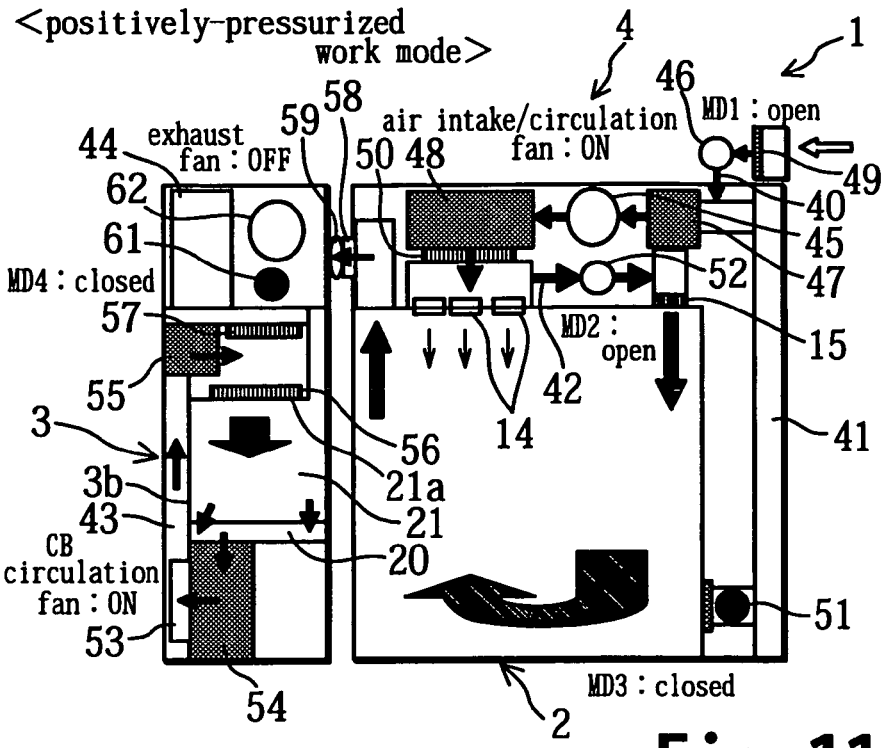
FIG. 11 is an explanatory diagram of the clean room unit in the positively-pressurized work mode.

As shown in FIG. 11, once the air conditioning system 4 enters the positively-pressurized work mode, the path 60 connecting the CB circulation path 43 and the exhaust path 44 is shut off, air inside the clean bench unit 3 circulates in the CB circulation path. Also, if the circulation path 41 is shut off, air is taken in through the air intake path 40, purified by the HEPA filter 50, and jetted to the work room 2 through the air nozzles 14 and the jet 15. Air inside the work room 2 is directly exhausted to the outside through the exhaust path 44. Because the exhaust fan 62 is stalled, the work room 2 becomes positively pressurized, and the interior of the clean bench unit 3 comes to have the room pressure.

Figure 12:
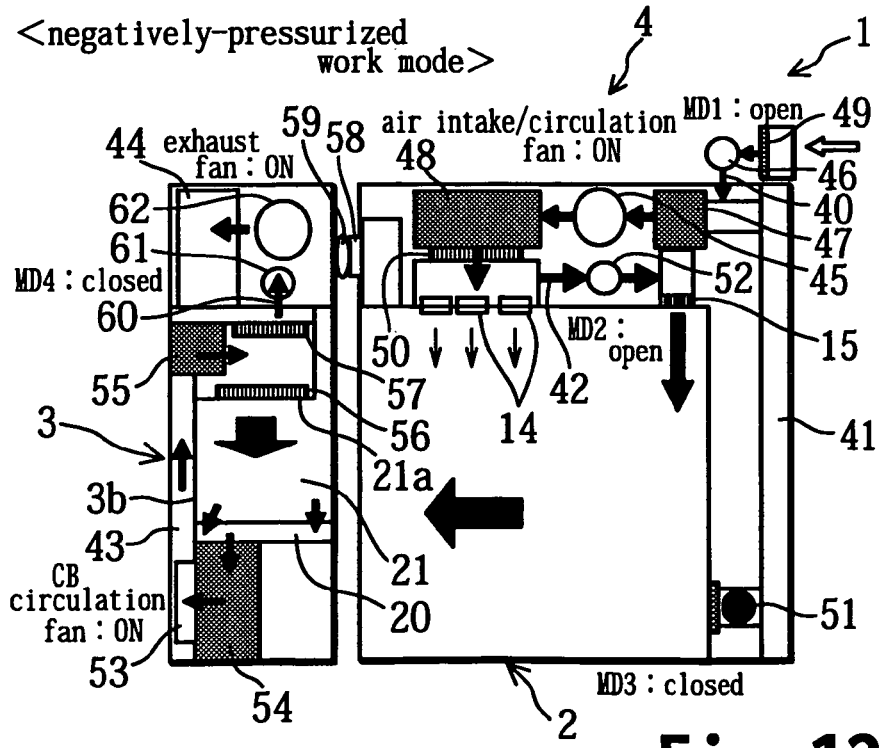
FIG. 12 is an explanatory diagram of the clean room unit in the negatively-pressurized work mode.

As shown in FIG. 12, once the air conditioning system 4 enters the negatively-pressurized work mode, the circulation path 41 is shut off, air is taken in through the air intake path 40, purified by the HEPA filter 50, and jetted to the work room 2 through the air nozzles 14 and the jet 15. A part of the air inside the work room 2 is exhausted to the outside directly through the exhaust path 44. Also, while air inside the clean bench unit 3 circulates in the circulation path 43, a part of that air is exhausted to the outside through the exhaust path 44. The exhaust rate through the exhaust fan 62 becomes higher than that of the air intake/circulation fan 45, making the work room 2 and the interior of the clean bench unit 3 negatively pressurized. Also, the interior of the clean bench unit 3 becomes lower in pressure than in the work room 2, and thus air inside the clean bench unit 3 stops leaking to the work room 2 through the work opening 22.

When the air conditioning system 4 is switched to the positively-pressurized work mode to make the work room 2 positively pressurized and the interior of the clean bench unit 3 have room pressure, and when the air conditioning system 4 is switched to the negatively-pressurized work mode to make the work room 2 and the interior of the clean bench unit 3 negatively pressurized, functioning fans 45, 53, and 62 are controlled to have the driving forces obtained by calculation or experimentally.

Hence, although the AS internal pressure sensor 81 and the CB internal pressure sensor 82 may be omitted, the control unit 5 judges whether a desired environment is reached based on the internal pressure detected with the CB internal pressure sensor 82, and if the desired environment is not reached, the driving forces of the fans 45, 53, and 62 can be corrected.

Note that the structure can be simplified by using multiple air nozzles 14 as both air jets in the air shower mode and air jets in the work mode.

Next, functions and advantages of the clean room 1 will be described.

In the clean room unit 1, the air conditioning system 4 can be exclusively switched to one of the air shower mode, the ventilation mode, the positively-pressurized mode, and the negatively-pressurized mode by operating the control panel 80.

Once the air conditioning system 4 is switched to the air shower mode, an air shower is generated in the work room 2, and a worker who entered the work room 2 can take this air shower to perform dust removal. Also, the worker who entered the work room 2 can sterilize his hands with the aseptic hand washer 75. The worker prepares medicines after dust removal and sterilization.

When the open/close shutter 23 is open, because the air conditioning system 4 is prevented from switching to the shower mode, an undesirable situation can be securely prevented in which an air shower is generated in the work room 2 with the open/close shutter 23 open, and that air from which dust has been removed by the air shower but containing dust etc. enters the interior of the clean bench unit 3 through the work opening 22.

After switching the air conditioning system 4 to the positively-pressurized work mode or the negatively-pressurized work mode, a worker inside the work room 2 can insert his hands into the work space 21 through the work opening 22 to prepare medicines on the work table 20.

Once the air conditioning system 4 is set to the positively-pressurized work mode, because the work room 2 becomes positively pressurized and outside air stops entering the work room 2, it is fit for the preparation of ordinary drugs. Also, once the air conditioning system 4 is set to the negatively-pressurized work mode, because the work room 2 becomes negatively-pressurized and air inside the work room 2 stops leaking to the outside, it is fit for the preparation of anti-cancer drugs (powerful medicine).

Before the worker enters the work room 2 and after the preparation of anti-cancer drugs, the air conditioning system 4 can be switched to the ventilation mode to forcibly ventilate the work room 2 and the interior of the clean bench unit 3.

With clean room unit 1, by installing the work room 2, clean bench unit 3, air conditioning system 4, and control unit 5, after entering the work room 2 a worker can take an air shower in the work room 2 and then prepare medicines, using the clean bench unit 3 in the work room 2, creating an environment fit for preparing medicine.

Because there is no need to install a pre-room having an air shower device separately as was conventionally done, and because an air shower can be generated by the air conditioning system 4, the need for installing a separate air shower device is eliminated. Furthermore, the work room 2 can be constructed to be compact, in which only one worker can enter and prepare medicines, miniaturizing the air conditioning system 4. Cost reduction can be realized as the result of miniaturizing the clean room unit 1.

Because the clean room unit 1 can be miniaturized and the clean room unit 1 can be installed independently inside a building, it is easy to secure a place in a medical facility in which the clean room unit 1 is located, making it possible to provide a very useful clean room unit 1, and replacing the conventional clean room, pre-room (air shower device), and clean bench.

Because the room in which this clean room unit 1 is placed does not need to be made a clean room, the facility cost can be substantially reduced. However, the clean room unit 1 may be placed in a clean room, in which case a desirable environment to prepare medicine can be created.

As shown in FIG. 7, a PC 83 installed in the clean room unit 1 is connected to an external host computer 91 via a LAN 90. Touch panel 85, keyboard 86 and mouse 87 are connected to PC 83. Installed in this host computer 91 are a medicine master data file 92, a patient data file 93, a medicine history data file 94, a prescription data file 95, a protocol data file 96, a preparation procedure data file 97, and an inspection data file 98.

In the medicine master data file 92, medicine master data of multiple kinds of medicines are stored, and stored as each medicine master data are data such as medicine code, medicine name, abbreviated name, standard amount, input unit, medicine classification, storage classification, ingredient amounts, and pH. Stored in the patient data file 93 are patient data of multiple patients, and stored as each patient data are data such as patient ID, name, age, sex, date of birth, address, telephone number, height, weight, and blood type.

Stored in the medicine history data file 94 are data on the history of medicines taken by each of multiple patients, and stored in the prescription data file 95 are data on the prescription created for each of multiple patients.

Stored in the protocol data file 96 are data on multiple protocols created for multiple cancer patients, and stored as each implementation protocol data are data such as patient ID, registration date, classification, patient's name, sex, date of birth, and age, clinical department, doctor in charge, patient's height, weight, and body surface area, disease name and cancer chemical therapy name, anti-cancer drugs to be administered, administration data of each anti-cancer drug, and dosage of each anti-cancer drug each time.

Stored in the preparation procedure data file 97 based on the prescription (prescription data) are preparation procedure data for preparing an anti-cancer drug by that prescription, or preparation procedure master data for creating the preparation procedure data.

Stored in the inspection data file 98 are inspection data which support inspection work after preparing an anti-cancer drug.

Data in these data files 92~98 are processed in the host computer 91 in cases, supplied from the host computer 91 to the PC 83, and the PC 83 can process the input data in cases and display them on a display 84. For example, the preparation procedure of a preparation work to be started immediately can be displayed on the display 84. For example, it can be arranged so that preparation procedure data be supplied automatically from the host computer 91 based on information in an IC chip 89 read with an IC chip reader 88.

Next, modifications of the clean room unit 1 will be described.

1] Switching to at least one of the air shower mode, ventilation mode, positively-pressurized work mode, and negatively-pressurized work mode may be performed interlocked with opening/closing of the open/close door 12 and the open/close shutter 23.

For example, it is arranged to switch automatically to the air shower mode (only for about 30 seconds for example) if the open/close door 12 is closed from the open state. Also, it is arranged to switch automatically from the air shower mode to the ventilation mode, positively-pressurized work mode, or negatively-pressurized work mode if the open/close door 12 is opened from the closed state under the air shower mode. It may be arranged so that an infrared sensor to sense a worker may be installed to automatically switch to the air shower mode when a worker has entered the work room 2.

2] It may be arranged so that an open/close actuator which drives the open/close shutter 23 open/close be installed, and when a switching operation to the air shower mode has been performed, if it is detected by the shutter open/close sensor 24 that the open/close shutter 23 is open, the open/close shutter 23 is automatically closed by the open/close actuator, and afterwards it is switched to the air shower mode to generate an air shower in the work room 2.

3] It may be arranged to install a locking mechanism which can lock the open/close shutter 23 in the closed state, and so that the open/close shutter will not open by the locking mechanism in a state where the open/close shutter 23 is closed and if it is not in the air shower mode.

4] It may be arranged so that the negatively-pressurized work mode be omitted, and that the air conditioning system 4 be switched exclusively to one of the air shower mode, the ventilation mode, and the positively-pressurized work mode. Also, it may be arranged so that the positively-pressurized work mode be omitted, and that the air conditioning system 4 be switched exclusively to one of the air shower mode, the ventilation mode, and the negatively-pressurized work mode. Also, the ventilation mode may be omitted.

5] The automatic mat replacement device 30, the medicine port 70, the PC 83, the IC chip reader 88, etc. may be omitted.

6] A printer may be installed connected to the PC 83. Then, it may be arranged so that the medicine data, patient data, medicine history data, prescription data, protocol data, preparation procedure data, inspection data, etc. are printed with this printer.

7] As to the size, shape, and internal configuration of the clean room unit 1, it may be given various kinds of sizes, shapes, and internal configurations other than those disclosed in the embodiment.

8] It may be constructed so that a microphone and a speaker be installed in the work room 2 of the clean room unit 1 and also a microphone and a speaker be installed in the part looking onto the exterior, so that the worker inside the work room 2 and a person outside can have a conversation.

9] Other than the above, embodiments can be made by adding various kinds of modifications within the range which does not deviate from the essence of the present invention.

What is claimed is:

1. A clean room unit which is provided with a work room isolated from the exterior and a clean bench unit which has a work opening facing to the work room and is installed independently inside a building:

said clean room unit comprising:

an air conditioning system which can perform purification and pressure control of air inside the work room and clean bench unit and can generate an air shower in the work room, and an air conditioning control means which controls the air conditioning system and can switch the air conditioning system between an air shower mode to generate an air shower in the work room and a work mode to enable specific work by making the work room positively pressurized or negatively pressurized, wherein the clean bench unit has an open/close shutter which opens/closes the work opening and a shutter open/close detection means which detects whether this open/close shutter is open or closed, and the air conditioning control means prohibits switching to the shower mode when it is detected by the shutter open/close detection means that the open/close shutter is open.

2. The clean room unit according to claim 1 wherein the clean bench unit has an automatic mat replacement device which automatically replaces a mat placed on a work table by sliding said mat.

3. The clean room unit according to claim 2 wherein the automatic mat replacement device has a mat supply unit wherein a rolled mat is mounted detachable and a mat winding means which feeds the mat mounted in this mat supply unit onto the work table successively and winds up the used mat successively.

4. The clean room unit according to claim 3, further comprising a mat remaining amount detection means which detects a remaining amount of the mat mounted in the mat supply unit and a mat remaining amount reporting means which reports the remaining amount of the mat detected by the mat remaining amount detection means.

5. The clean room unit according to claim 1, further comprising a display which a worker in the work room can see and an information processing computer for controlling the display so as to show at least medicine information.

6. The clean room unit according to claim 5, further comprising a medicine port for passing medicine into or out of the work room and an IC chip reader for reading medicine information from an IC chip attached to the medicine or medicine tray taken into the work room through this medicine port.

7. The clean room unit according to claim 6 wherein the IC chip is attached to the medicine tray, and the IC chip reader is installed in a medicine port on which the medicine tray can be placed.

8. The clean room unit according to claim 1 wherein the work mode includes a negatively-pressurized work mode wherein the work room and the clean bench unit interior are negatively pressurized.

9. The clean room unit according to claim 1 wherein the work mode includes a positively-pressurized work mode which makes the work room positively pressurized and gives the clean bench unit interior a room pressure.

10. The clean room unit according to claim 1, wherein the air conditioning control means is constituted so as to be capable of switching the air conditioning system exclusively to one of the air shower mode, the work mode, and the ventilation mode which forcibly ventilates the work room and the clean bench unit interior while performing air intake and exhaust.

11. The clean room unit according to claim 1 wherein the air conditioning system has an air intake path through which air is taken into the work room, a work room circulation path which includes a part of the air intake path, a clean bench unit circulation path, a common exhaust path which exhausts air from the work room and the clean bench unit, an air intake/circulation fan and an air intake switching damper installed in the air intake path, a circulation switching damper installed in the work room circulation path, a clean bench unit circulation fan installed in the clean bench circulation path, an exhaust damper installed in a path connecting the clean bench unit circulation path and the exhaust path, and an exhaust fan installed in the exhaust path.

12. The clean room unit according to claim 11 wherein the air conditioning system has multiple silencers installed in each of the air intake path and clean bench unit circulation path.

13. The clean room unit according to claim 1 wherein multiple air nozzles are installed on a ceiling of the work room and these air nozzles are used both as air jets in the air shower mode and air jets in the work mode.

* * * * *